United States Patent [19]

Galimand

[11] Patent Number: 4,753,187

[45] Date of Patent: Jun. 28, 1988

[54] INDIVIDUAL SUBMARINE DIVING EQUIPMENT

[75] Inventor: Patrice Galimand, Paris, France

[73] Assignee: Groupe Design MBD, Paris, France

[21] Appl. No.: 71,571

[22] Filed: Jul. 10, 1987

Related U.S. Application Data

[63] Continuation of Ser. No. 841,536, filed as PCT FR84/00147 on Jun. 8, 1984, published as WO86/00056 on Jan. 3, 1986.

[51] Int. Cl.[4] ..... B63C 11/46

[52] U.S. Cl. ..... 114/315; 405/185; 440/6

[58] Field of Search ..... 114/315, 333, 338; 440/6; 405/185, 186; D21/237, 238

[56] References Cited

U.S. PATENT DOCUMENTS

| | | | |
|---|---|---|---|
| 3,014,448 | 12/1961 | Fogarty et al. | 114/315 X |
| 3,034,467 | 5/1962 | Pestronk | 114/315 X |
| 3,329,118 | 4/1967 | Strader | 114/315 |
| 3,820,348 | 6/1974 | East | 114/315 X |
| 3,916,814 | 11/1975 | Bardoni et al. | 114/315 |
| 3,995,578 | 12/1976 | McCullough | 114/315 X |
| 4,467,742 | 8/1984 | Duboy | 114/315 |

FOREIGN PATENT DOCUMENTS

| | | | |
|---|---|---|---|
| 2445324 | 1/1976 | Fed. Rep. of Germany | 114/315 |
| 2537538 | 6/1984 | France . | |

*Primary Examiner*—Galen Barefoot
*Assistant Examiner*—Paul E. Salmon
*Attorney, Agent, or Firm*—Browdy and Neimark

[57] ABSTRACT

The individual submarine diving equipment comprises a breathing module (MR) and a propulsion module (MP) which modules are separable, the propulsing module being releasable as desired. The equipment is a self-contained propulsion and breathing apparatus of a weight at the most equal to the weight of a conventional so-called "bi-steel" diving suit while retaining a breathing autonomy at least equal to that of the diving suit. The invention is generally applicable to nautical equipments.

12 Claims, 4 Drawing Sheets

INDIVIDUAL SUBMARINE DIVING EQUIPMENT

This is a continuation of application Ser. No. 841,536, filed as PCT FR84/00147 on Jun. 8, 1984, published as WO86/00056 on Jan. 3, 1986 and now abandoned.

This invention relates to an individual diving equipment for submarine diving.

Propulsion machines in the form of a torpedo for traction of divers are known.

While they are of simple and reliable design and realization, such machines are actuated at arms' length thereby causing non negligible drawbacks: unavailability of the arms; hampered visibility (position of the device in the field, propeller flux); noninstinctive movement of the diver; the machine being held at arms' length, it being the orientation of the propulser which pulls the diver on. Moreover, the propulsing machine being in positive flotation, as soon as the diver leaves it, it has to be secured to the bottom by any means to be recoverable later on.

This invention remedies such inconveniences and its object is an individual submarine diving equipment characterized in that it both comprises propulsion means and breathing means so that it constitutes an autonomous propulsion and breathing equipment.

The composite material technology has served the development of many fields and among others the field of compressed gas bottles constituted by an internal shell of lightweight alloy reinforced by an external winding for example of glass fibers.

Such technology permits to obtain a very strong air storage container (the pressure in use can be for example 300 bars instead of 200 bars now in use with steel bottles) and significant weight saving.

This invention further develops the application of the composite material technology to compressed gas bottles by aiming, apart from weight saving, at a reduced outer bulk in bottles in order to contribute to the provision of both breathing and propulsive means accommodated on the same submarine diving equipment.

The equipment according to the invention comprises a breathing module and a propulsion module separable as desired, with the propulsive module being releasable without modification to the weight/volume balance.

Moreover certain elements in such modules can be advantageously provided in the extension of one another without damage to the overall length of the equipment.

Anyhow, the organization of the two-module assembly is provided such that its general bulk permits to obtain satisfactory diving performances, with its weight remaining at most equal to the weight of the usual diving suit called "bisteel" while keeping the breathing autonomy at least equal to that of such a diving suit.

The object of this invention is more particularly but not exclusively such bottles realized from a metallic core preferably of aluminum alloy, such core being coated with a stratification of filamentary winding, glass fiber or carbon fiber, depending on the desired performance level.

Other characteristics and advantages of this invention will appear from the following description which is made in reference to the attached drawings in which.

Figure 1:
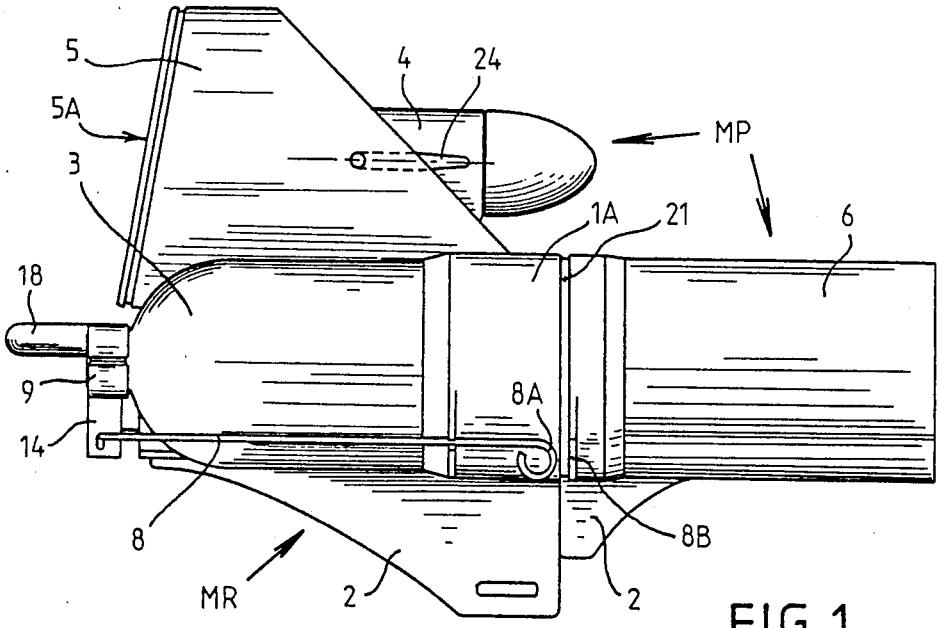
FIG. 1 is a lateral elevational view of an equipment according to the invention.
Figure 2:
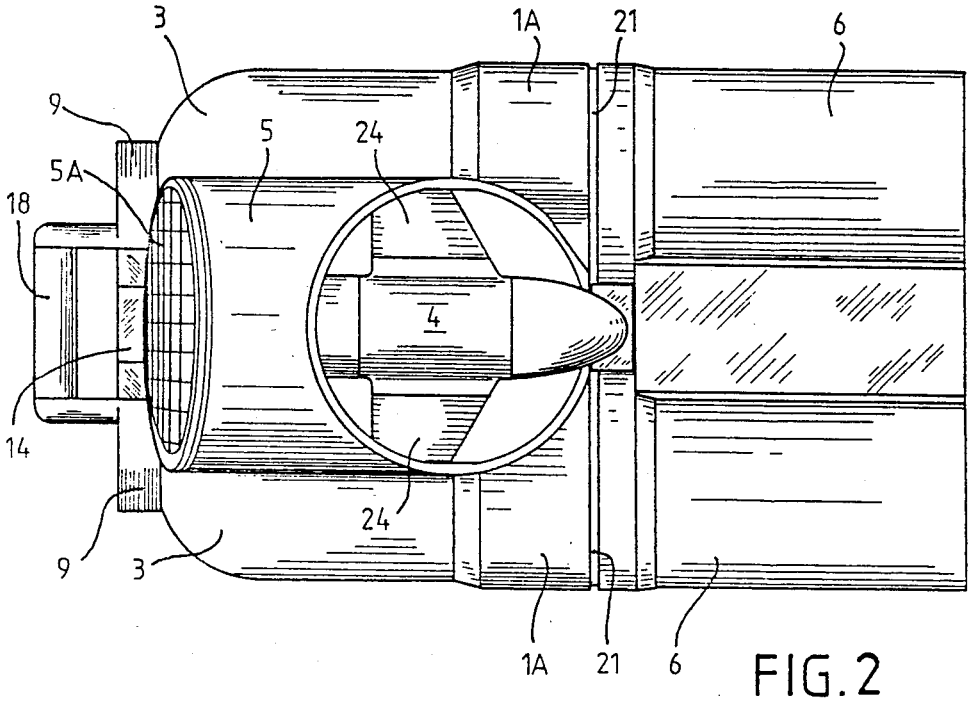
FIG. 2 is a plan view from the top of this same equipment.
Figure 4:
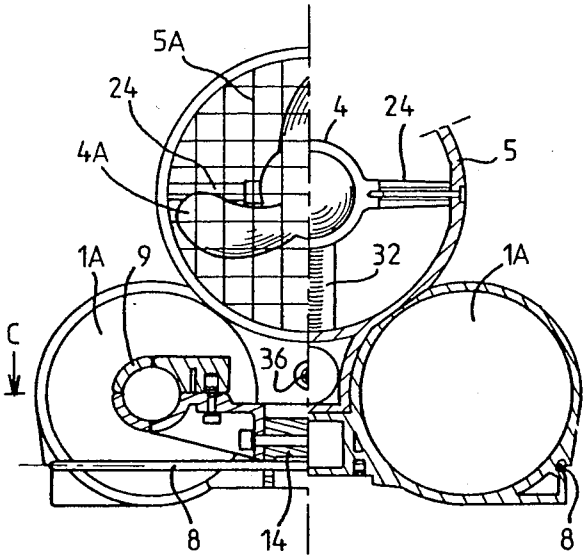
FIG. 4 represents two half cross-sections according to lines A—A and B—B of FIG. 3.
Figure 3:
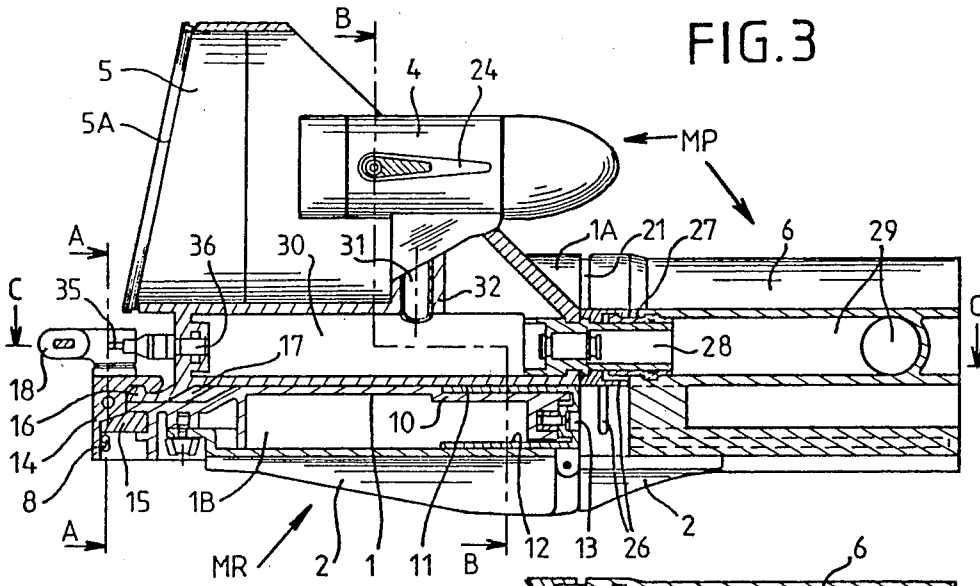
FIG. 3 is a longitudinal cross-sectional view thereof.
Figure 5:
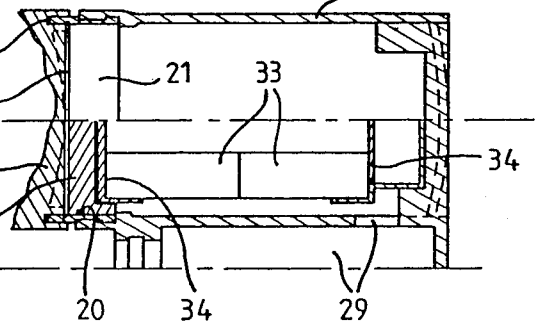
FIG. 5 is a partial sectional view of the equipment according to the invention along line C—C of FIG. 3.
Figure 6:
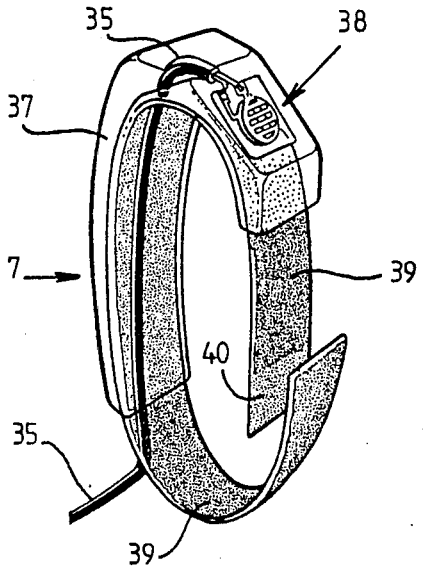
FIG. 6 is a perspective view of a manual control for the propulsion module engine, internal elements of such control being also represented.
Figure 7:
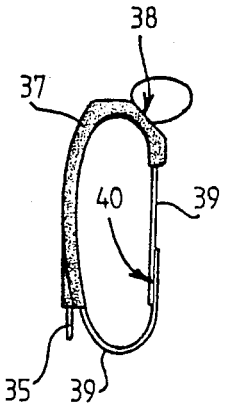
FIGS. 7, 8 and 9 show the control as disposed on the diver's hand so as to permit actuation by the thumb of one's hand according to a movement within the plane of the hand's profile.
Figure 8:
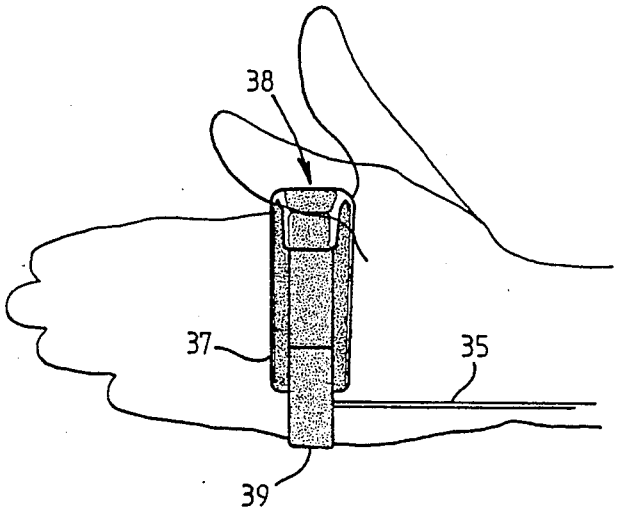
Figure 9:
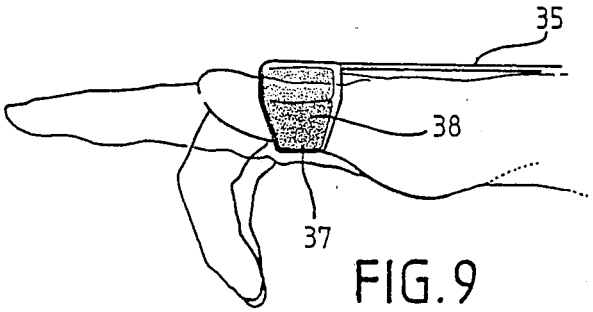

In the form of the embodiment shown, an equipment according to the invention comprises two modules that can be separated as desired:

a breathing module (MR) comprising a cradle (1), a backing (2) and two air bottles (3) received in two lodgings (1A) secured to the cradle.

a propulsion module (MP) comprising an engine (4) with a propeller (4A) and its streamlining (5), a container (6) for an autonomous electric power source (dry cell accumulators) and an autonomous control (7) (FIGS. 6 to 9).

The container (6) is double and is advantageously disposed in the extension of the lodgings (1A), that is, the container with two sections is located adjacent a bottom part of each said bottle and extends in axial alignment from a bottom part of each bottle of the breathing module at an end of each bottle that is opposite the direction for propelling of the diver. Such installation leaves the hand free and does not modify diving habits.

It maintains the diver's safety, the propulsive module (MP) being releasable as desired without modification of the weight/volume balance through a release control with linkages (8) having beaks (8A) that can engage wings (88) located on the periphery of the double container (6).

The propulsive module is weighted to positive floatation so as to be recoverable.

The cradle (1), preferably made of a material of low density and high mechanical strength, for example according to the technology of lightened thermoplastic materials, comprises elements which permit the fulfilling of several functions.

Sleeves (9) of such cradle, into which the necks of the bottles are fitted, enable the latter to be maintained within the interaxis thereof.

A tenon (10) on the cradle is insertable into a mortise (11) formed in a connecting bridge (12) which connects together both lodgings (1A) for receiving the bottles, and is fixed therein by a screw (13).

The cradle also carries a hinged latch (14) biased by a spring (15) and onto which there is locked a hook (16) of the streamlining (5) of the propulsive module which finds room between both lodgings (1A) and against the cradle (1). The cradle is formed with a recess (17) therein to permit lock-in or release of the hook (16) of the streamlining by sliding into said recess.

Release of the hook (16) means release of the propulsive module (MP), the latch (14) actuated in such case against the bias of its spring (15) also causing the linkages (8) to press on the wings (8B) of the container (6).

Therefore, the diver may if necessary release the propulsive module without however modifying its floatation balance. The use of the breathing module (MR) alone is thus possible during the diving.

On its face turned away from the engine streamlining, the cradle (1) comprises a ballasting compartment (1B) to permit control of the equipment floatation so that it can be very slightly negative in full load (for example, moving down supplementary bottles to a given site).

The cradle comprises moreover a carrying handle (18) and connection elements to the support backing (2) which is made of two sections.

Both sections of the support backing provide for the holding of the equipment by means of five straps adjustable so as to be properly adjusted and to limit movement thereof on the diver's back. These include two shoulder straps for height adjustment to the torso, two crotch straps providing for downward pulling and a belt strap providing for connection of the four mentioned straps and transverse stability in the equipment.

The volume of the container for the cell accumulator (6) with two bodies is designed so that the cell battery assembly lies in positive floatation. It is also preferably realized according to lightweight thermoplastic material technology.

A cover (19) of aluminum alloy and a toroidal seal (20) provide for tightness on a metallic bearing (21) moulded on or in each body of the container. A keeper (22) of stainless steel provides for the locking thereof.

Double penetration of the bearings (21) of the container bodies for the cell batteries (6) into circular grooves (23) formed in the sockets of the lodgings (1A) for receiving the bottles, provides for the centering and guiding of the modules.

As described above, the latch (14) permits to unlock both modules by means of the release linkages (8).

The low voltage electric motor (4) coupled with a speed reducer provides slow rotation of the propeller. Electronic regulation is associated therewith to optimize consumption (chopping off peaks in the power absorbed on start up, regulation of the supplied voltage, safety in case of propeller blocking).

The streamlining (5) of the motor (4) with the propeller (4A) is preferably realized according to the same technology as that for the cradle (1). It comprises a protective grid (5A) for the propeller, a floatation reserve (equal to the motor weight) and two stabilization fins (24). The latter have the purpose of aligning the tractive force and the center of gravity of the diver for motion through the water, while resisting the torque produced by the direction of rotation of the propeller.

Moreover the fins participate in the maintaining of the motor and propeller assembly within the streamlining which is preferably circular.

Securement between the motor streamlining (5) and the double container for the cell batteries (6) is effected by the blocking of a lock (26) by a quarter revolution on a bearing (27) imprisoned by the container (6).

The lock (26) revolves about an intermediary segmented tube (28) which provides for tightness and passage of the electric connection between batteries, motor and control. Such connection is also used as an electric connection to proceed to the recharging of the batteries.

Passage of the electric connection is also ensured by a channel (29) in the double container (6) and a channel (30) in the streamlining (5). A well (31) connects the channel (30) to the motor and such well is formed in a spacer (32) for the main securement of the motor.

The batteries (33) maintained between two boxes (34) are contained in the two bodies of the container (6). The dry cell accumulators constituting the batteries are preferably of the nickel-cadmium type with extra thin with extra thin plates. Selection of this type of dry cells results in particular from their characteristics of tightness, total lack of maintenance, voltage stability in the discharge even at high rate, insensitiveness to high overloads, their excellent performances from −40° C. to +50° C., their shock and vibration strength, the modular presentation of their elements for constituting power supply blocks and their longevity.

The total capacity is calculated for a time period of one and a half hours, corresponding to the use of a bottle of 2.4 $m^3$, most currently used by divers.

With due account to the power absorbed by the motor, the total capacity of the batteries is calculated so as to continuously cover the breathing autonomy including decompression stages and without the use of the safety reserve.

The control (7), the connection wire (35) of which extends to (36) at the end of the channel (30) in the streamlining (5), is realized by an elastomeric moulding-on (37) of a contactor of the deformable thin layer type (38). It feeds a coil of a monostable power relay (not shown) to supply voltage to the motor. The moulding-on (37) has the general form of a buckle portion which is completed by a strip (39) preferably having pressure connecting means (40). The whole of the buckle can be disposed about the diver's hand so that his thumb can actuate the contactor, not by the natural gripping movement but in a movement lying in the plane of the hand's profile, mainly in order to prevent any untimely actuation by an involuntarily tightened hand thereon.

Such control through application of the thumb in the plane of the hand's profile makes it possible to provide a voluntary grip by the other fingers closing in towards the palm.

The control is preferably actuated by the other hand than the usual one (left hand for the right handed person; right hand for the left handed person) so as to let the more skilful hand free.

Figure 10:
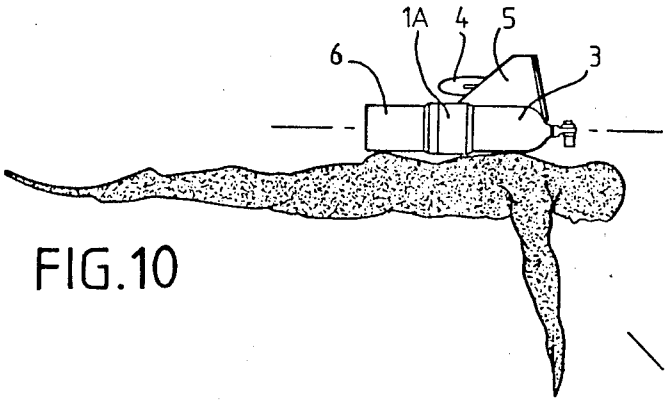
FIGS. 10, 11 and 12 show the underwater displacement of a diver provided with an individual submarine diving equipment according to the invention.
Figure 11:
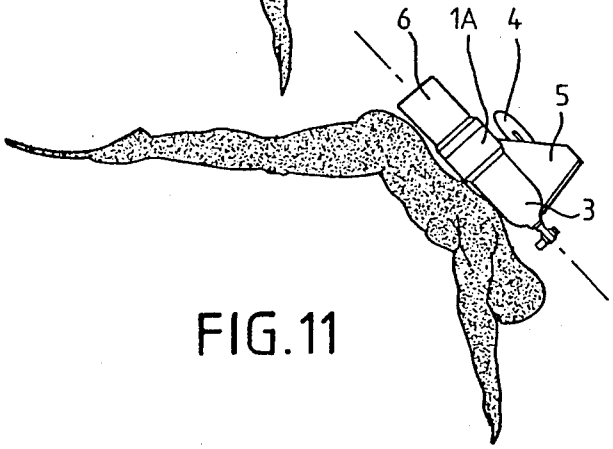
Figure 12:
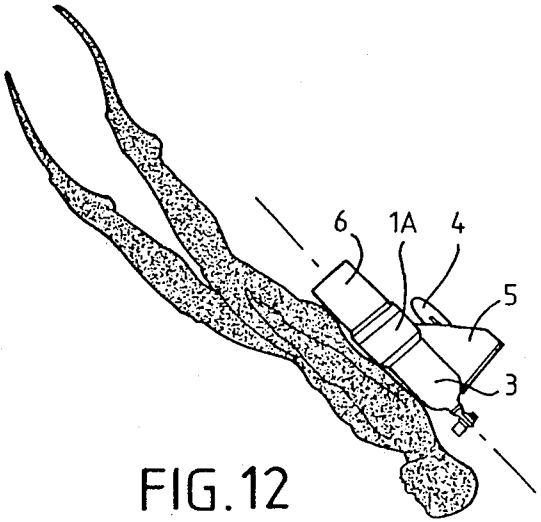

The individual submarine diving equipment according to the invention therefore presents the following advantages:

availability of one's hands, simplification of underwater movement; same diving habit; instinctive displacement (FIGS. 10, 11 and 12):

breathing autonomy comparable to the existing bottles, safety for the diver in all the diving phases, bulk and weight as reduced as possible, comparable to an autonomous diving suit of the "bisteel" type, autonomous control, storage and renewal of energy and air by the user, structure adapted to the marine medium.

Finally, it will be understood that this invention was only described and represented in a preferential form of embodiment and that equivalent parts can be substituted for its constituents without however departing from the scope of the invention.

Thus, all conditions being unchanged, number of bottles may vary i.e., one, two, or more bottles, depending on the use.

What is claimed is:

1. An individual submarine device for propelling a diver, including:

a breathing module comprising at least one air bottle and means for holding it on the back of the diver, each said bottle having a shape extending along an axis of the bottle and with said axis aligned substantially parallel with a direction for said propelling of said diver; and a motor module, comprising a motor with a propeller and streamlining disposed along said breathing module, on a side of said breathing module that is opposite from a further side thereof with said holding means, and a container for an autonomous electric power source, said container being located adjacent a bottom part of each said bottle and which extends in axial alignment from said bottom part thereof, at an end of the bottle that is opposite said direction for said propelling of said diver, wherein each said bottle and container, with said streamlining disposed therealong, provide effective hydrodynamics along said direction for propelling said diver and wherein the breathing module comprises a cradle bearing two of said air bottles and two lodgings for receiving said bottles therein, and the container has two sections, each of them being located at said bottom part of a respective bottle.

2. The device of claim 1, said cradle having a hinged latch connected therewith, and said motor module having a hook for locking with said latch, wherein said breathing and motor modules are caused to be separated from one another by releasing said hook from said latch.

3. The device of claim 2, comprising complementary release means for pushing upon the container when actuated by the releasing of said hook from said latch.

4. The device of claim 3, wherein said complementary release means includes linkages having beaks that bear upon respective peripheral parts of the two sections of the container.

5. The device of claim 2, wherein the cradle is formed with a recess therein to permit lock-in or release of the hook of the motor module by sliding into said recess.

6. The device of claim 2, comprising penetration means disposed between the container and the lodgings for the bottles for centering and guiding the connection of both modules.

7. The device of claim 1, wherein said cradle comprises sleeves for receiving necks of said bottles therein.

8. The device of claim 1, said cradle having a ballasting compartment therein to control flotation of the device.

9. The device of claim 1, comprising a lock for securing the streamlining to the container.

10. The device of claim 9, comprising a central tube about which said lock is rotatable, wherein water tightness and passage of electric connection between the container and the motor are provided.

11. The device of claim 1, comprising a control for the motor realized by a moulding-on of a contactor of the deformable thin layer type, said moulding-on having the form of a buckle portion completed by a strip having pressure connecting means for connection around a hand of the diver, the buckle element being disposable around the diver's hand so that his thumb can act upon the contactor in a movement lying in a plane of a profile of said hand of said diver.

12. The device of claim 1, wherein said streamlining comprises stabilization fins located so as to align a force of the propeller for said propelling of the diver and the diver's center of gravity for motion through the water and to oppose the torque produced by the direction of rotation of the propeller.

* * * * *